United States Patent [19]

Clegg et al.

[11] 4,040,818

[45] Aug. 9, 1977

[54] ADDITION OF MAGNESIUM TO MOLTEN METAL

[75] Inventors: Gordon A. Clegg, Rossendale; Geoffrey Maurice Cull, Salford; Phillip Andrew Fisher, Urmston; William Unsworth, Manchester, all of England

[73] Assignee: Magnesium Elektron Limited, Manchester, England

[21] Appl. No.: 632,823

[22] Filed: Nov. 17, 1975

[30] Foreign Application Priority Data

Nov. 20, 1974 United Kingdom ..... 50263/74

[51] Int. Cl.[2] ..... C22C 33/08

[52] U.S. Cl. ..... 75/58; 75/53; 75/130 R

[58] Field of Search ..... 75/58, 53, 130

[56] References Cited

U.S. PATENT DOCUMENTS

| | | | |
|---|---|---|---|
| 2,980,530 | 4/1961 | Crome | 75/130 R |
| 3,065,070 | 11/1962 | Otani | 75/130 R |
| 3,231,368 | 1/1966 | Watson | 75/130 R |
| 3,446,614 | 5/1969 | Johnson | 75/53 |
| 3,748,121 | 7/1973 | Atterbury | 75/53 |
| 3,801,303 | 4/1974 | Kotler | 75/58 |

*Primary Examiner*—Peter D. Rosenberg
*Attorney, Agent, or Firm*—Karl W. Flocks

[57] ABSTRACT

An additive for a ferrous melt to remove sulphur comprises agglomerates of a mixture of from 15 to 50% by weight of magnesium, 1 to 10% by weight of calcium fluoride and a refractory material to form a metal-permeable matrix when subjected to the temperature of a ferrous melt. The agglomerates may contain a binder and be formed into briquettes. The additive may be introduced into the melt by plunging.

21 Claims, No Drawings

ADDITION OF MAGNESIUM TO MOLTEN METAL

BACKGROUND OF INVENTION

This invention relates to magnesium additives for ferrous melts.

It is known that magnesium may be incorporated in molten iron and steel in order to remove undesired sulphur from the melt and to convert the iron to nodular form on casting. However magnesium has a boiling point of 1107° C which is substantially lower than the melting points of iron alloys and consequently the uncontrolled addition of magnesium metal to a ferrous melt produces magnesium vapour which escapes from the melt and burns on contact with the atmosphere. Most of the magnesium is thus wasted and the burning vapour constitutes a serious hazard.

U.S. Pat. No. 3,957,502 discloses a magnesium based additive for a ferrous melt and particles of a refractory material inert to magnesium at the melting point of the latter, the structure being such that the refractory material forms a coherent metal-permeable matrix around the magnesium particles when subjected to the temperature of a ferrous melt. The constituents of the additive may be aggregated to form briquettes. It is mentioned that calcium fluoride may be added, preferably in quantities in excess of 10%, to improve the efficiency of utilisation of the magnesium. Magnesium should react with calcium fluoride at an elevated temperature to produce involatile magnesium fluoride and elementary calcium which like magnesium reacts with sulphur, to form calcium sulphide, which is thus removed from the melt. However calcium has a boiling point in the region of 1500° C and so little calcium is likely to leave the melt as vapour.

It has now been found that the use of briquettes which contain more than 50% by weight of magnesium, while giving a more moderate reaction than pure magnesium, still give a quite violent emission of magnesium vapour. It has also been found that an increased content of calcium fluoride for a given proportion of magnesium gives a more violent reation, apparently because the calcium fluoride acts as a flux which has the effect of causing progressive fusion of the surface layers of the briquettes in contact with the molten ferrous melt. If a high content of calcium fluoride is used the matrix is destroyed by this melting before the magnesium has fully diffused into the melt. On the other hand, it is desirable that some fluxing action should take place to decompose the matrix after the reaction to avoid the presence, on the surface of the melt, of residual lumps of material. Eventual decomposition of the matrix is particularly desirable when the additive is added to the melt by plunging, in which case it is pushed under the surface of the melt in a bell. Residual matrix material may stick to the underside of the bell, which consequently requires repair or cleaning; the removal of the matrix material by fluxing helps to avoid this occurrence. A calcium fluoride content from 1 to 10% enables a suitable rate of decomposition of the matrix to be achieved.

SUMMARY OF INVENTION

Thus, according to the present invention an additive for a ferrous melt comprises an agglomerated substantially homogeneous mixture of from 15 to 50% by weight of magnesium particles and from 1 to 10% by weight of calcium fluoride, the balance comprising particles of a refractory material which is inert to magnesium at the melting point of the latter, the refractory material providing a coherent metal-permeable matrix when subjected to the temperature of a ferrous melt. The mixture may be pressed to form a briquette.

DESCRIPTION OF PREFERRED EMBODIMENTS

The magnesium content of the agglomerate is most advantageously from 20 to 40% by weight. An increased magnesium content gives a faster but less efficient reaction (i.e. the amount of magnesium which is effectively used to remove sulphur is reduced) and a reduced magnesium content, besides giving a slower reaction and increased efficiency, increases the cost of the additive per kg of magnesium because of the increased cost of the other constituents. The calcium fluoride content is preferably from 2 to 8% by weight, advantageously 2 to 6%.

The refractory material may be any refractory which is more or less inert to the ferrous melt and to magnesium at the temperature of the melt (generally of the order of 1200° - 1500° C). These materials include carbon, magnesium oxide and dolomite; the latter is preferred because of its low cost. The preferred grain size of the refractory material is of the order of 20 to 250 microns.

The size and shape of the magnesium particles are not critical, although magnesium turnings are desirably avoided as they are more difficult to incorporate in satisfactory briquettes. The preferred size range is from 0.115 to 4 mm, desirably 0.5 to 3 mm.

A binder may be added to the mixture in order to assist formation of a briquette. A wide range of organic binders, such as phenol-formaldehyde compositions, may be used for this purpose. It is desirable for economic reasons to use the minimum quantity of binder while maintaining the strength of the green briquettes at a satisfactory level and with phenol-formaldehyde binders this minimum falls between 2 to 8% by weight of binder solids, frequently 3 to 6% by wieght of binder solids.

The rate of erosion of refractory matrix may be further modified by the incorporation in the agglomerate of other fluxing agents, for example sodium carbonate which may be present in an amount of up to 5% by weight.

It has been found that the shape of the briquettes (ovoid, rectangular etc.) does not have an appreciable effect on their performance when added to the ferrous melt. The preferred volume of the briquettes is from 15 to 150 $cm^3$; a very large size produces a slower reaction and a very small size results in heat transfer characteristics which are less satisfactory.

In order to obtain briquettes having a satisfactory predictable decomposition rate on addition to the ferrous melt the constituents should be mixed as uniformly as possible and should be bound together in a uniform manner, in order to give a matrix which decomposes at a predictable rate. This end may be achieved by first forming the constituents into granules, having a diameter of 0.5 - 6 mm for example, and then forming the granules into "green" briquettes by pressing. It should be understood that the granules may contain one or more particles of magnesium. The green briquettes may then be heated to "cure" the binder to produce a strong briquettes which will not collapse on subsequent handling or disintegrate prematurely when added to the melt.

In a preferred procedure the granules are prepared in a rotary mixer, to which the magnesium particles are first charged followed by sufficient binder, generally added in the form of a solution, to wet the particle surfaces, and then a proportion of the other solid constituents of the briquette. Further quantities of binder and solid constituents are then added alternately to produce granules. These granules are then pressed in a press of conventional type at a pressure sufficient to give a briquette having adequate green strength; a pressure of from 4 to 25 tons per square inch is generally adequate. The green briquettes are then heated in order to cure the binder. In the case of phenol-formaldehyde binders heating at a temperature of 135° to 300° C for from 30 to 90 minutes is sufficient to cure the binder and give a briquette of adequate strength.

It has been found that briquettes having a composition which is substantially uniform throughout and which are uniformly bonded, such as may be obtained by the above-described procedure, give a much more uniform and predictable reaction rate in the melt than pieces of coke which have been impregnated with molten magnesium. Coke impregnated with magnesium cannot be made as a uniform composition, nor can calcium fluoride easily be incorporated in the coke. Further, the proportion of magnesium contained by the coke is determined by the initial porosity of the coke and so the proportion of magnesium cannot be regulated to a desired value.

The magnesium particles may be of substantially pure magnesium, but may also comprise alloys containing magnesium as the major constituent together with other metals which are to be added to the ferrous melt as alloying additives. For example, a magnesium alloy containing up to 10% by weight of rare earth metals such as cerium may be used.

Embodiments of the invention will be described in the following non-limiting Examples.

EXAMPLE

Briquettes were made containing varying proportions of magnesium particles having an average size from 0.5 to 3 mm, magnesium oxide particles having a particle size distribution of 10–15% less than 20 microns and 85–90% between 20 and 250 microns, calcium fluoride particles and a 65% solution of a phenol-formaldehyde resin in industrial methylated spirits.

The magnesium oxide and fluorspar were first mixed. 20 kg of the magnesium was charged into a rotating mixer and wetted with 2 liters of the resin solution. 20 kg of the MgO/fluorspar mixture in the weight ratio of 14:1 was then added, followed by 1 liter of resin solution. Further quantities of $MgO/CaF_2$ mixture and resin were alternately added, ending with a further addition of magnesium oxide, until the charge in the mixer amounted to about 87 kg (dry weight). Substantially spherical granules of about 0.5 – 6 mm diameter were obtained.

The granules were removed from the mixer and charged into a press, in which they were compressed at a specific pressure from 4 to 25 tons/square inch to form briquettes of volume from 15 to 150 $cm^3$. The briquettes were then heated at 150° C for 60 minutes to cure the binder resin.

Briquettes containing different percentages of magnesium and calcium fluoride were prepared by this method and varying quantities of the briquettes were added to 200 tonne batches of molten iron in a conventional ladle by the plunging method. The degree of reaction violence was estimated visually and recorded on a numerical scale from 1 (little violence) to 6 (high violence). The time required to achieve substantially complete reaction was noted. The sulphur content of each batch of iron was measured before and after addition of the briquettes by conventional analysis, and the "desulphurization efficiency" (reaction efficiency) was calculated as the weight of magnesium chemically equivalent to the weight of sulphur removed expressed as a percentage of the total weight of magnesium added. The results obtained are expressed in the following Table.

TABLE 1

| Magnesium (%) | Reaction violence | Reaction time (Mins) | Desulphurization efficiency (%) |
|---|---|---|---|
| 45 | 6.4 | 2.4 | 25 |
| 40 | 4.9 | 4.5 | 41 |
| 35 | 3.4 | 6.6 | 56 |
| 30 | 1.9 | 8.7 | 72 |

The briquettes contained 5% by weight of calcium fluoride and the amount of magnesium used in each trial was constant. It is evident from these results that the reaction violence decreases and the desulphurization efficiency increases with decreasing magnesium content, but the reaction time also increases. The cost of the briquettes per unit amount of magnesium also increases with decreasing magnesium content. Trials were carried out under the same conditions but using briquettes containing 40% magnesium and varying amounts of calcium fluoride. The results obtained are shown in Table 2.

TABLE 2

| Calcium Fluoride (%) | Reaction violence | Reaction time (Mins) | Desulphurization efficiency (%) |
|---|---|---|---|
| 10 | 6 | 3 | 28 |
| 5 | 3.2 | 5.6 | 46 |
| 3 | 2.4 | 6.7 | 53 |

The amount of magnesium used in each trial was constant. It can be seen that the reaction violence decreases and the efficiency increases with decreasing calcium fluoride content, but the reaction time increases.

A further set of trials were carried out using the procedure described above but the amount of magnesium added to the melt per tonne of iron was varied. The desulphurization efficiency was measured and the following results were obtained.

TABLE 3

| Magnesium (Kg/tonne of Iron | Desulphirization efficiency % |
|---|---|
| 0.375 | 36 |
| 0.325 | 42 |
| 0.300 | 46 |
| 0.290 | 48 |
| 0.280 | 56 |

These results illustrate the increasing efficiency of the briquettes according to the invention as the amount of magnesium added tothe melt is reduced.

The magnesium and calcium fluoride used were of ordinary commercial purity. The magnesium oxide gave 93.4% by weight MgO on analysis, the remainder consisting substantially of $SiO_2$, $Al_2O_3$, $Fe_2O_3$, $TiO_2$, $Mn_2O_3$, $Cr_2O_3$ and CaO.

Blast furnace iron in integrated steel plants normally contains about 0.03–0.04% sulphur by weight. Using briquettes of the kind described above it has been found that a reduction of the sulphur content to about 0.007–0.01% is achieved by one plunge using 0.295 kilograms of magnesium per tonne of molten metal.

However, melts from the blast furnace occasionally contain less sulphur, about 0.02% by weight, and in these cases a plunge using the same amount of magnesium can give a final sulphur content which is much lower. The results in Table 4 below were obtained using one plunge with 0.295 Kg of Mg per tonne of molten metal.

TABLE 4

| Initial sulphur % | End Sulphur % |
|---|---|
| 0.022 | 0.004 |
| 0.021 | 0.004 |
| 0.021 | 0.004 |

Although the additives of the invention may advantageously be used in briquette form it should be understood that they may also be added to melts in unbriquetted form, for example as agglomerates having a size range of 0.5 to 6 mm. In this case they are conveniently added by lance injection or with stirring of the melt, for example by means of a Rheinstahl paddle.

We claim:

1. An additive for a ferrous melt comprising an agglomerated, substantially homogeneous mixture of from 15 to 50% by weight of magnesium particles and from 1 to 10% by weight of calcium fluoride, the balance comprising particles of a refractory material which is inert to magnesium at the melting point of the latter, the refractory material providing a coherent metal-permeable matrix when subjected to the temperature of the ferrous melt.

2. An additive according to claim 1, which contains from 20 to 40% by weight of magnesium.

3. An additive according to claim 1, which contains from 2 to 8% by weight of calcium fluoride.

4. An additive according to claim 1, in which the magnesium particles have an average grain size from 0.125 to 4 mm.

5. An additive according to claim 4, in which the magnesium particles have an average grain size from 0.5 to 3 mm.

6. An additive according to claim 1, in which the refractory material is magnesium oxide.

7. An additive according to claim 1, in which the refractory material has an average grain size from 20 to 250 microns.

8. An additive according to claim 1, containing an organic binder.

9. An additive according to claim 8, containing from 2 to 8% by weight of a phenol-formaldehyde resin as a binder.

10. An additive according to claim 1, which contains up to 5% by weight of sodium carbonate.

11. An additive according to claim 1, in which the mixture is agglomerated into granules containing one or more particles of magnesium, the granules having an average grain size from 0.5 to 8 mm.

12. An additive according to claim 11, in which the granules have an average grain size from 0.5 to 6 mm.

13. An additive according to claim 1, in which the mixture is formed into briquettes having a volume from 15 to 150 $cm^3$, said briquettes having a composition which is substantially uniform throughout and uniformly bonded.

14. A method of making an additive for a ferrous melt which comprises mixing from 15 to 50% by weight of magnesium particles and from 1 to 10% by weight of calcium fluoride, the balance comprising particles of a refractory material which is inert to magnesium at the melting point of the latter, and forming said mixture into substantially homogeneous agglomerates, the refractory material providing a coherent metal-permeable matrix when subjected to the temperature of the ferrous melt.

15. A method according to claim 14, in which the agglomerates have an average grain size form 0.5 to 6 mm.

16. A method according to claim 15, in which the mixture contains an organic binder and the agglomerates obtained are heated to cure the binder.

17. A method according to claim 16, in which the binder is a phenol-formaldehyde resin and the agglomerates are heated to a temperature from 135° to 300° C for a period from 30 to 90 minutes.

18. A method according to claim 15, in which the agglomerates are pressed together to form briquettes.

19. A method according to claim 18, in which the agglomerates are heated during pressing.

20. A method according to claim 14, in which the agglomerates are formed by applying portions of a solution of an organic binder and portions of the calcium fluoride and refractory material to the magnesium particles alternately until an average grain size from 0.5 to 6 mm is achieved.

21. A method of adding magnesium to a ferrous melt, which comprises immersing an additive according to claim 1 in the melt.

* * * * *